United States Patent [19]

Jacobsen

[11] Patent Number: 4,862,669

[45] Date of Patent: Sep. 5, 1989

[54] ALIGNMENT AND SUPPORT TOOL FOR BUILDING SIDING

[76] Inventor: Richard Jacobsen, 23 Lantz Ave., Whitman, Mass. 02382

[21] Appl. No.: 121,631

[22] Filed: Nov. 16, 1987

[51] Int. Cl.[4] ..... E04D 15/00

[52] U.S. Cl. ..... 52/749; 54/DIG. 1; 33/646; 33/648

[58] Field of Search ..... 52/127.2, 749, DIG. 1; 33/411, 646, 648

[56] References Cited

U.S. PATENT DOCUMENTS

| | | | |
|---|---|---|---|
| 386,329 | 7/1888 | Luce et al. | 33/646 |
| 774,114 | 12/1903 | Spear | 33/411 |
| 1,151,141 | 8/1915 | Wheeler | 33/411 X |
| 1,989,141 | 1/1935 | Leonard | 33/648 |
| 3,792,852 | 2/1974 | Reniker | 33/648 X |
| 3,904,184 | 9/1975 | Kreuger | 52/DIG. 1 |
| 4,089,141 | 5/1978 | Heroux | 52/DIG. 1 |
| 4,654,975 | 4/1987 | Lopez | 33/646 X |

*Primary Examiner*—Carl D. Friedman

*Attorney, Agent, or Firm*—John M. Brandt

[57] ABSTRACT

An alignment and support tool for positioning siding boards to be secured to a building consisting of an elongated upright, a hook attached to the bottom of the upright for securing the tool by wedging underneath an attached siding board, and one or more siding supports extending from the upright toward the building.

3 Claims, 1 Drawing Sheet

ALIGNMENT AND SUPPORT TOOL FOR BUILDING SIDING

BACKGROUND OF THE INVENTION

1. Field of the Invention:

The invention resides in the field of building construction tools and more particularly relates to guides for the installation of siding.

2. Description of the Prior Art:

A number of jigs, brackets, clips, and other such devices exist in the prior art for the purpose of installing building covering material such as siding. For example, U.S. Pat. No. 2,511,083,Small; and 3,903,670, Robinson both disclose clip assemblies which hold alumininum or vinyl type siding to a wall and remain permanently installed in place on the building.

Three other U.S. Patents known to the inventor show removable fixtures which hold wood siding in place for nailing. 3,904,184, Kruger describes a hanger which is nailed to the wall above the board to be secured and then is removed by outward rotation. Similarly, 4,089,141, Heroux discloses a bracket with scale markings which is nailed to the wall and then removed by sliding down and out from under the respective siding board after the boards attachment. Finally, 4,314,429, Casteel, shows a supporting bracket which hooks over the top edge of a board already installed and has means for varying the position of the work piece in relationship to the next lower board.

In contrast to the above, the present invention is arranged to allow the installation of a plurality of boards after a single tool set up step, and, as a result does not require continual fixture removal and resetting for the attachment of each piece. Further, the invention does not require nailing the fixture to the wall utilizing instead the pinching force of a siding board already secured in place. Final alignment can be accomplished by light tapping and thereby provides the possibility for installing large sections of siding by a single person.

Additionally, the construction of the invention is inherently rugged resulting in a device which will last a substantial number of years and because of its size will not easily be lost at construction work sites.

SUMMARY OF THE INVENTION

The invention may be summarized as a building siding alignment and support tool or fixture setting and holding such boards in place for nailing. The device, preferably used in pairs, consists of an elongated upright having at least one but, more advantageously, several spaced apart board supports extending outwardly from the upright about the thickness of one board. A hook extends outwardly from the bottom portion of the upright position having a horizontal segment of a length about the thickness of one board. A vertical segment in the shape of a pointed tapered wedge extends upwardly from the horizontal segment and is designed to be driven between a building wall and a siding board already attached to the wall.

In use, the hook is tapped into place securing the upright in a desired portion. One or more additional units of the above described device are similarly placed a distance apart from the first along the building. Alignment is accomplished by the use of for example a snap line. As the supports now completely define the correct position for as many boards as there are support tiers the siding is then simply dropped over the top automatically assuming the correct overlapping position for nailing. After the boards are nailed in place, the fixtures are removed by tapping downward. The process is then repeated using the uppermost board as the new base.

The above described features and advantages of the invention will be more fully understood from the description of the preferred embodiment and drawings which follows.

DESCRIPTION OF THE PREFERRED EMBODIMENT

Figure 1:
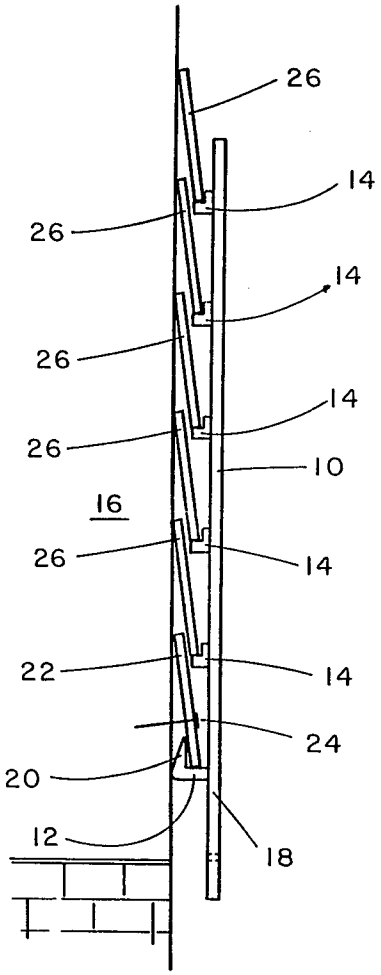
FIG. 1 is a side view of the preferred embodiment of the invention.

Referring to FIG. 1, there is illustrated a side view of the fixture comprising the invention consisting of elongated upright 10, hook 12, and siding supports 14. The device is shown in position on building wall 16. Hook 12 having horizontal segment 18 and vertical segment 20 is driven under base siding board 22. Horizontal segment 18 is approximately the width of the thickness of a siding board and preferably just a small amount larger to prevent scratching of the baseboard during installation and removal. Vertical segment 20 is a tapered, pointed wedge shaped member which is forced between the wall and the board which is held in place by nails 24 as shown in FIG. 2.

Siding supports 14 are approximately the width of the thickness of a siding board, and preferably are just short of that thickness to prevent scratching of the adjoining board during removal. The supports are spaced apart a selected distance corresponding to the desired overlap of the siding. As would be obvious they may be adjustable using a slot and thumb screw or similar arrangement.

Figure 2:
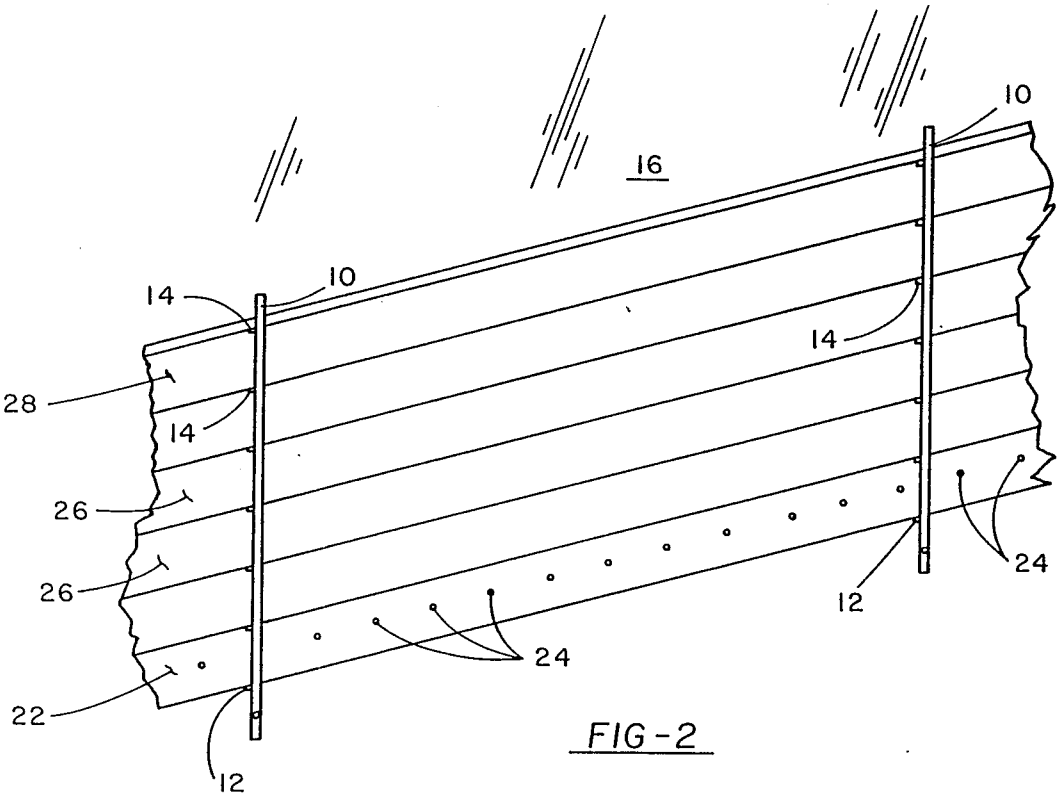
FIG. 2 is a perspective view of FIG. 1 in use.

FIG. 2 shows the invention in use. Additional boards 26 have been positioned for nailing, the uppermost 28 of which is shown uncovered for purposes of illustration.

Figure 3:
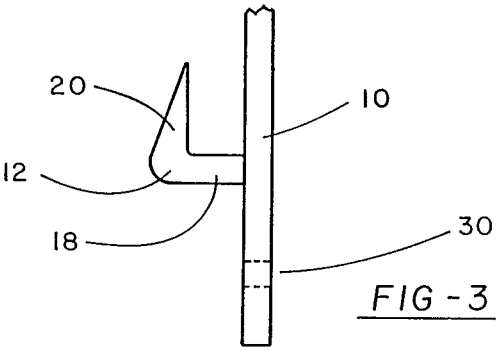
FIG. 3 is an enlarged side view of a portion of FIG. 1

FIG. 3 is an enlarged view of the hook member and the lower portion of upright 10 showing nail hole 30 which may be used as an additional means of securing the invention in the vertical position if desired.

Variations in the construction of the above described device will be obvious to those skilled in the art. Accordingly the invention is defined by the following claims.

What is claimed is:

1. An alignment and support tool for positioning siding boards of a selected thickness to be secured to a building comprising in combination:

a. an elongated upright member;

b. a hook attached to the lower end of said upright member said hook composed of a horizontal segment and a vertical segment, said horizontal segment of said hook extending outwardly approximately the thickness of said siding, and said vertical segment comprising a tapered wedge shaped member extending upwardly from said horizontal segment said tapered wedge shaped member being tapered from front to back;

c. a siding support attached to said upright member extending outwardly approximately the thickness of said siding and in the same direction as said horizontal segment, said support spaced apart from said horizontal segment a distance equivalent to a selected portion of said siding.

2. The apparatus of claim 1 further including an additional plurality of said siding supports, each aligned with said first support and each spaced successively from each other a distance equivalent to said selected exposed siding portion.

3. The apparatus of claim 1 wherein said upright member has a nail hole disposed in the lower end below said hook.

* * * * *